US011158244B2

(12) United States Patent
Hung et al.

(10) Patent No.: US 11,158,244 B2
(45) Date of Patent: Oct. 26, 2021

(54) PIXEL CIRCUIT SUITABLE FOR BORDERLESS DESIGN AND DISPLAY PANEL INCLUDING THE SAME

(71) Applicant: AU Optronics Corporation, Hsin-Chu (TW)

(72) Inventors: Chia-Che Hung, Hsin-Chu (TW); Mao-Hsun Cheng, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/880,203

(22) Filed: May 21, 2020

(65) Prior Publication Data

US 2021/0090489 A1 Mar. 25, 2021

(30) Foreign Application Priority Data

Sep. 25, 2019 (TW) ..... 108134714

(51) Int. Cl.
*G09G 3/32* (2016.01)

(52) U.S. Cl.
CPC ..... *G09G 3/32* (2013.01); *G09G 2300/0439* (2013.01); *G09G 2310/0286* (2013.01); *G09G 2320/0247* (2013.01); *G09G 2320/0626* (2013.01)

(58) Field of Classification Search
CPC ..... G09G 3/32; G09G 2300/0439; G09G 2310/0286; G09G 2320/0247; G09G 2320/0626
See application file for complete search history.

(56) References Cited

U.S. PATENT DOCUMENTS

| | | | | |
|---|---|---|---|---|
| 7,019,717 | B2 | 3/2006 | Yumoto et al. | |
| 9,468,050 | B1 | 10/2016 | Rotzoll et al. | |
| 2016/0224157 | A1 | 8/2016 | Yang | |
| 2018/0301081 | A1* | 10/2018 | Wang | G11C 19/28 |

FOREIGN PATENT DOCUMENTS

| | | | |
|---|---|---|---|
| CN | 107016971 A | * | 8/2017 |
| CN | 108182908 A | * | 6/2018 |

* cited by examiner

*Primary Examiner* — Kenneth Bukowski
(74) *Attorney, Agent, or Firm* — WPAT, PC

(57) ABSTRACT

A pixel circuit including a writing circuit, a compensation circuit, a reset circuit, a brightness control circuit, and a light emission control circuit is provided. The writing circuit provides a first data signal and a second data signal. A first compensation unit of the compensation circuit provides, in a first time period, a first driving current according to the first data signal. A second compensation unit of the compensation circuit provides, in a second time period separated from the first time period, a second driving current according to the second data signal. The reset circuit provides a reference voltage to the compensation circuit. The light emission control circuit conducts the first compensation unit to the brightness control circuit in the first time period, and conducts the second compensation unit to the brightness control circuit in the second time period.

18 Claims, 15 Drawing Sheets

PIXEL CIRCUIT SUITABLE FOR BORDERLESS DESIGN AND DISPLAY PANEL INCLUDING THE SAME

CROSS-REFERENCE TO RELATED APPLICATION

This application claims priority to Taiwan Application Number 108134714, filed on Sep. 25, 2019, which is herein incorporated by reference in its entirety.

BACKGROUND

Field of Invention

The present disclosure generally relates to pixel circuits and a display panel suitable for the splicing application. More particularly, the present disclosure relates to pixel circuits help to reduce the number of shift registers in the display panel.

Description of Related Art

Conventional active-matrix micro LED display usually controls pixel circuits thereof by supplying two different types of signals having very different pulse widths. One type of these signals may have a pulse width of 3.9 microseconds (μs), usually for data writing control of the pixel circuit. The other type of these signals may have a pulse width of 8.3 μs, usually for controlling timing of emitting light of the pixel circuit. As such, these two types of signals have very dissimilar waveforms, and two sets of shift registers are required to be disposed on two sides of a glass substrate as the signal sources respectively for these two types of signals. However, shift registers disposed on two sides of displays causes black boarders that hard to be ignored in the application of splicing displays.

In addition, when conventional micro LED displays updates images, the pixel circuit receiving data switches off the micro LED thereof to prevent unstable transient brightness. However, rapidly switching between extinguish state and lighting state causes image flicker phenomenon.

SUMMARY

The disclosure provides a pixel circuit including a writing circuit, a compensation circuit, a reset circuit, a brightness control circuit, and a light emission control circuit. The writing circuit is configured to provide a first data signal and a second data signal. The compensation circuit includes a first compensation unit and a second compensation unit. The first compensation unit is configured to provide, in a first time period, a first driving current according to the first data signal. The second compensation unit is configured to provide, in a second time period, a second driving current according to the second data signal. The first time period is separated from the second time period. The reset circuit is configured to provide a reference voltage to the compensation circuit. The light emission control circuit is coupled with the first compensation unit, the second compensation unit, and the brightness control circuit. The light emission control circuit conducts, in the first time period, the first compensation unit to the brightness control circuit so that the brightness control circuit emits light according to the first driving current. The light emission control circuit conducts, in the second time period, the second compensation unit to the brightness control circuit so that the brightness control circuit emits light according to the second driving current.

The disclosure provides a pixel circuit including a shift register, a plurality of pixel circuit. The shift register is configured to provide a plurality of first scan signals and a plurality of second scan signals. The plurality of pixel circuit is coupled with the shift register. Each of the plurality of pixel circuit includes a writing circuit, a compensation circuit, a reset circuit, a brightness control circuit, and a light emission control circuit. The writing circuit is configured to provide a first data signal and a second data signal. The compensation circuit includes a first compensation unit and a second compensation unit. The first compensation unit is configured to store, in a first time period, the first data signal according to a corresponding one of the plurality of first scan signals to provide a first driving current. The second compensation unit is configured to store, in a second time period, the second data signal according to a corresponding one of the plurality of second scan signals to provide a second driving current. The first time period is separated from the second time period. The reset circuit is configured to provide a reference voltage to the compensation circuit. The light emission control circuit is coupled with the first compensation unit, the second compensation unit, and the brightness control circuit. The light emission control circuit conducts, in the first time period, the first compensation unit to the brightness control circuit according to a first emission signal so that the brightness control circuit emits light according to the first driving current. The light emission control circuit conducts, in the second time period, the second compensation unit to the brightness control circuit according to a second emission signal so that the brightness control circuit emits light according to the second driving current, and the first emission signal is opposite to the second emission signal.

It is to be understood that both the foregoing general description and the following detailed description are by examples, and are intended to provide further explanation of the disclosure as claimed.

DETAILED DESCRIPTION

Figure 1:
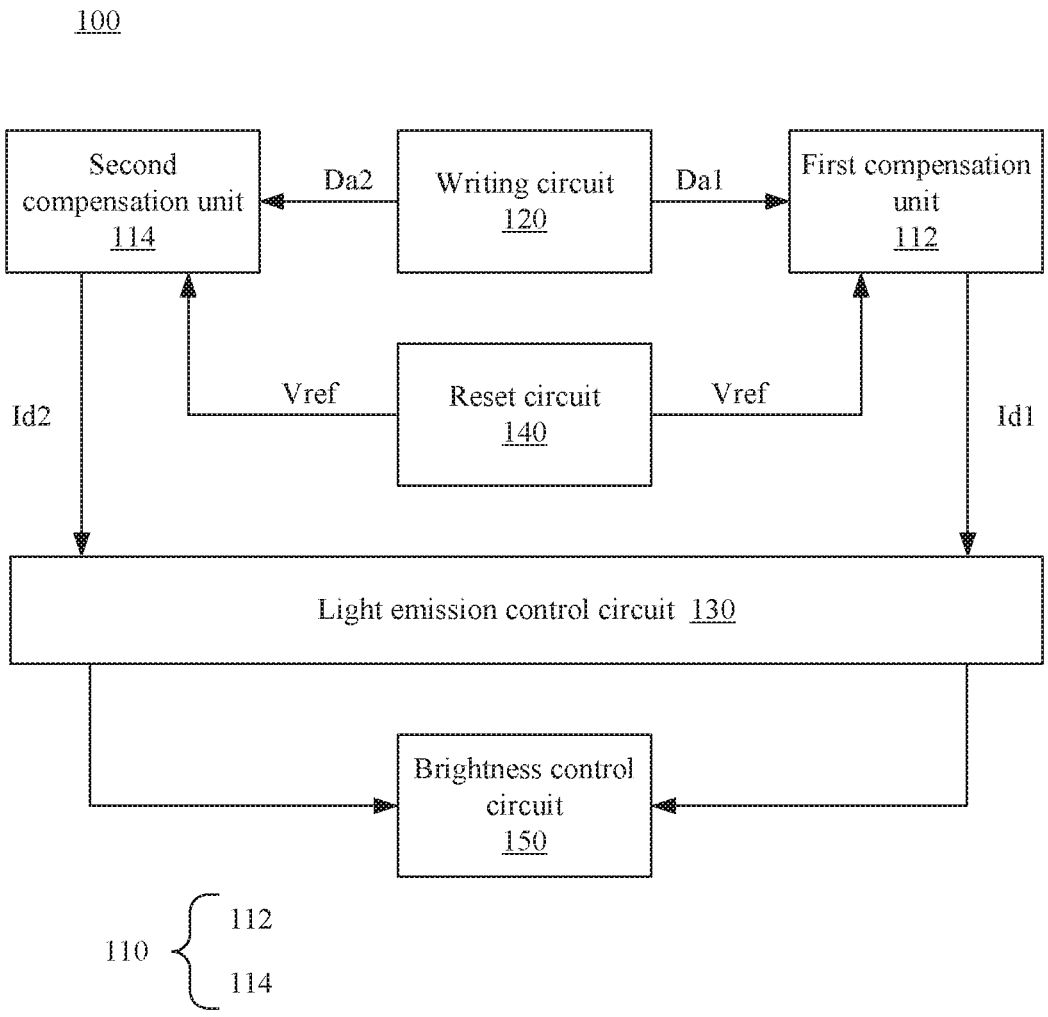
FIG. 1 is a simplified functional block diagram of a pixel circuit according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a simplified functional block diagram of a pixel circuit 100 according to one embodiment of the present disclosure. The pixel circuit 100 comprises a compensation circuit 110, a writing circuit 120, a light emission control circuit 130, a reset circuit 140, and a brightness control circuit 150.

The compensation circuit 110 comprises a first compensation unit 112 and a second compensation unit 114. The writing circuit 120 is configured to provide a first data signal Da1 and a second data signal Da2 to the first compensation unit 112 and the second compensation unit 114, respectively. The first compensation unit 112 determines magnitude of a first driving current Id1 according to the first data signal Da1. The second compensation unit 114 determines magnitude of a second driving current Id2 according to the second data signal Da2.

In some embodiments, the compensation circuit 110 further configured to detect characteristics of one or more components thereof, and outputs the first driving current Id1 and the second driving current Id2 compensated according to the detection result so that the first driving current Id1 and the second driving current Id2 are immune to the characteristic variation of the compensation circuit 110.

The light emission control circuit 130 couples between the compensation circuit 110 and the brightness control circuit 150. The light emission control circuit 130 is configured to conduct the first compensation unit 112 to the brightness control circuit 150, or to conduct the second compensation unit 114 to the brightness control circuit 150. That is, the brightness control circuit 150 will not be conducted to both of the first compensation unit 112 and the second compensation unit 114. Therefore, the brightness control circuit 150 emits light according to one of the first driving current Id1 and the second driving current Id2.

The reset circuit 140 is configured to provide the reference voltage Vref to the compensation circuit 110 to switched off one of the first compensation unit 112 and the second compensation unit 114.

In a first frame of this embodiment, the reset circuit 140 disables the first compensation unit 112 so that the first compensation unit 112 stops outputting the first driving current Id1 and stores the first data signal Da1. In this situation, the light emission control circuit 130 disconnects the first compensation unit 112 and the brightness control circuit 150, and the second compensation unit 114 provides the second driving current Id2 to the brightness control circuit 150.

In a second frame successive to the first frame, the reset circuit 140 disables the second compensation unit 114 so that the second compensation unit 114 stops outputting the second driving current Id2 and stores the second data signal Da2. In this situation, the light emission control circuit 130 disconnects the second compensation unit 114 and the brightness control circuit 150, and the first compensation unit 112 provides, according to the stored first data signal Da1, the first driving current Id1 having a corresponding magnitude to the brightness control circuit 150, so on and so forth, the pixel circuit 100 may be operated in the similar manner in subsequent frames.

In other words, the pixel circuit 100 maintains stable brightness while updating internal node voltages, and thus the pixel circuit 100 needs not to stop emitting light when updating internal node voltages. Therefore, the pixel circuit 100 has an advantage of reducing flicker.

Figure 2:
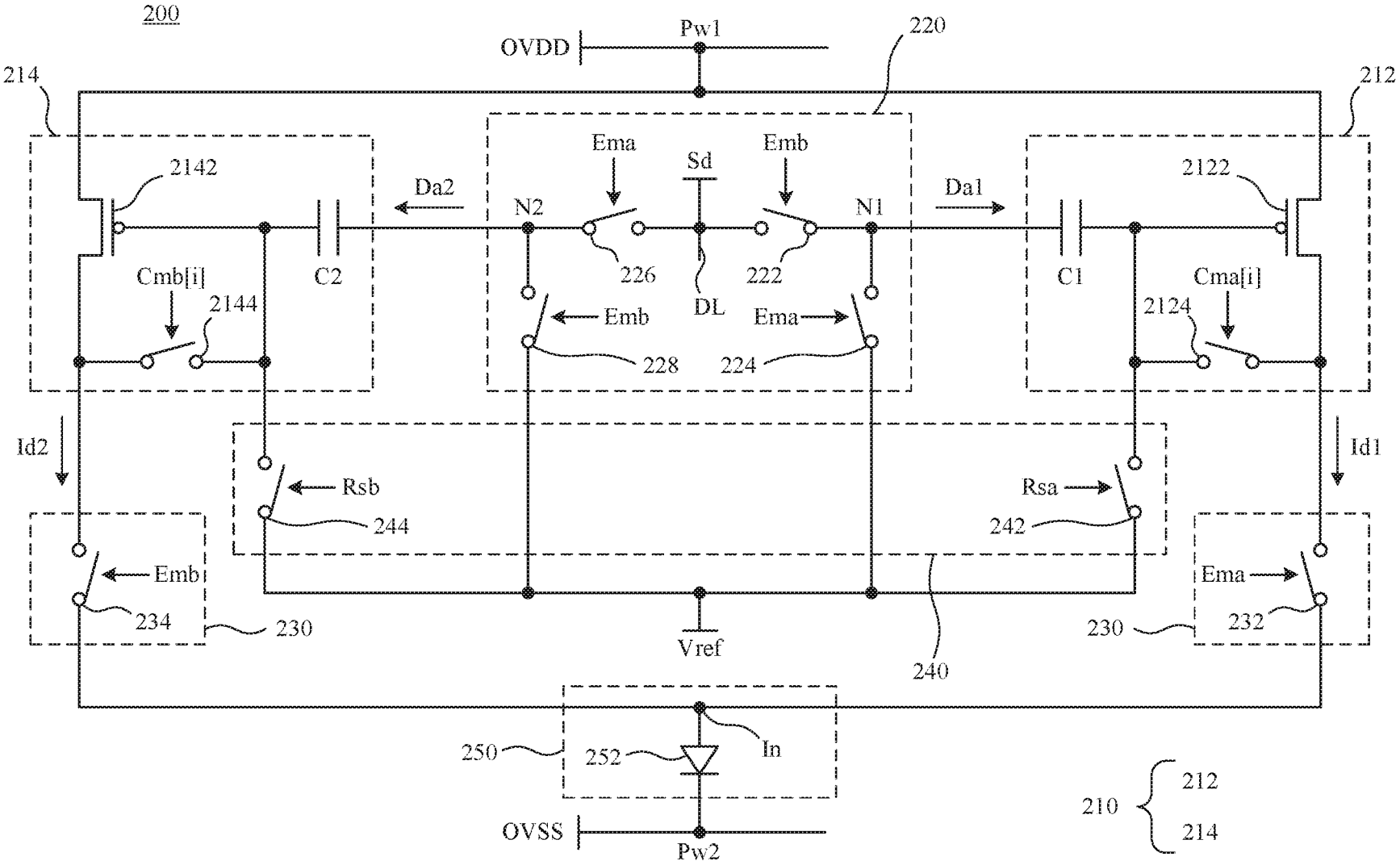
FIG. 2 is a functional block diagram of a pixel circuit according to one embodiment of the present disclosure.

FIG. 2 is a functional block diagram of a pixel circuit 200 according to one embodiment of the present disclosure. The pixel circuit 200 comprises a compensation circuit 210, a writing circuit 220, a light emission control circuit 230, a reset circuit 240, and a brightness control circuit 250.

The compensation circuit 210 may be used to realize the compensation circuit 110 of FIG. 1, and the compensation circuit 210 comprises a first compensation unit 212 and a second compensation unit 214. The first compensation unit 212 comprises a first driving transistor 2122, a first compensation switch 2124, and a first capacitor C1. Each of the first driving transistor 2122 and the first compensation switch 2124 comprises a first terminal, a second terminal, and a control terminal. The first terminal of the first compensation switch 2124 is coupled with the control terminal of the first driving transistor 2122. The second terminal of the first compensation switch 2124 is coupled with the second terminal of the first driving transistor 2122. The control terminal of the first compensation switch 2124 is configured to receive the first scan signal Cma[i]. The first capacitor C1 is coupled between the writing circuit 220 and the control terminal of the first driving transistor 2122, and is configured to receive the first data signal Da1 from the writing circuit 220.

The second compensation unit 214 comprises a second driving transistor 2142 and a second compensation switch 2144. Each of the second driving transistor 2142 and the second compensation switch 2144 comprises a first terminal, a second terminal, and a control terminal. The first terminal of the second compensation switch 2144 is coupled with the control terminal of the second driving transistor 2142. The second terminal of the second compensation switch 2144 is coupled with the second terminal of the second driving transistor 2142. The control terminal of the second compensation switch 2144 is configured to receive the second scan signal Cmb[i]. The second capacitor C2 is coupled between the writing circuit 220 and the second driving transistor 2142, and is configured to receive the second data signal Da2 from the writing circuit 220.

The first terminal of the first driving transistor 2122 and the first terminal of the second driving transistor 2142 are coupled, in a parallel connection, with the first power terminal Pw1 so as to receive the system high voltage OVDD from the first power terminal Pw1.

The writing circuit 220 may be used to realize the writing circuit 120 of FIG. 1, and the writing circuit 220 comprises a first node N1, a second node N2, a first writing switch 222, a second writing switch 224, a third writing switch 226, and a fourth writing switch 228. Each of the first writing switch 222, the second writing switch 224, the third writing switch 226, and the fourth writing switch 228 comprises a first terminal, a second terminal, and a control terminal.

The first node N1 and the second node N2 are configured to provide the first data signal Da1 and the second data signal Da2, respectively, and are coupled with the first capacitor C1 and the second capacitor C2 of the compensation circuit 210, respectively.

The first terminal of the first writing switch 222 and the first terminal of the second writing switch 224 are coupled with the first node N1. The first terminal of the third writing switch 226 and the first terminal of the fourth writing switch 228 are coupled with the second node N2. The second terminal of the first writing switch 222 and the second terminal of the third writing switch 226 coupled with a data line DL. The second terminal of the second writing switch 224 and the second terminal of the fourth writing switch 228 are configured to receive the reference voltage Vref.

The data line DL is configured to provide a display signal Sd to the pixel circuit 200. In one embodiment, the data line DL is coupled with the data driving circuit 320 of the display panel 300 of FIG. 11, and is configured to receive the display signal Sd from the data driving circuit 320. The operations of the display panel 300 will be further described in the following paragraphs.

Reference is made again to FIG. 2. The light emission control circuit 230 may be used to realize the light emission control circuit 130 of FIG. 1. The light emission control circuit 230 comprises a first emission switch 232 and a second emission switch 234. Each of the first emission switch 232 and the second emission switch 234 comprises a first terminal, a second terminal, and a control terminal.

The first terminal of the first emission switch 232 is coupled with the second terminal of the first driving transistor 2122. The control terminal of the first emission switch 232 is configured to receive the first emission signal Ema. The first terminal of the second emission switch 234 is coupled with the second terminal of the second driving transistor 2142. The control terminal of the second emission switch 234 is configured to receive the second emission signal Emb. The second terminal of the first emission switch 232 and the second terminal of the second emission switch 234 are coupled, in a parallel connection, with the brightness control circuit 250.

The reset circuit 240 may be used to realize the reset circuit 140 of FIG. 1. The reset circuit 240 comprises a first reset switch 242 and a second reset switch 244. Each of the first reset switch 242 and the second reset switch 244 comprises a first terminal, a second terminal, and a control terminal. The first terminal of the first reset switch 242 is coupled with the control terminal of the first driving transistor 2122. The control terminal of the first reset switch 242 is configured to receive the first reset signal Rsa. The first terminal of the second reset switch 244 is coupled with the second compensation unit 114. The control terminal of the second reset switch 244 is configured to receive the second reset signal Rsb. The second terminal of the first reset switch 242 and the second terminal of the second reset switch 244 are configured to receive the reference voltage Vref.

In one embodiment that the plurality of pixel circuits 200 are formed as a pixel array (not shown in FIG. 2), all pixel circuits 200 in the pixel array together receive the first emission signal Ema, the second emission signal Emb, the first reset signal Rsa, and the second reset signal Rsb. Therefore, the first emission signal Ema, the second emission signal Emb, the first reset signal Rsa, and the second reset signal Rsb may be generated by a timing controller (TCON) which disposed on a flexible printing circuit board (FPCB) such as the timing control circuit 310 of FIG. 11, and needs not to be generated by shift registers disposed on the glass substrate, thereby reducing border thickness. The methods of generating the control signals for the pixel circuit 200 will be further described in the following paragraphs in reference with FIG. 11. In some embodiments, the first emission signal Ema, the second emission signal Emb, the first reset signal Rsa, and the second reset signal Rsb may also be generated by the shift register (e.g., the shift register 330 of FIG. 11).

Reference is made again to FIG. 2. The brightness control circuit 250 comprises an input terminal In and a first light emission element 252. The input terminal In is coupled with the second terminal of the first emission switch 232 and the second terminal of the second emission switch 234, and is configured to receive the first driving current Id1 and the second driving current Id2 from the light emission control circuit 230. A first terminal of the first light emission element 252 (e.g., the anode) is coupled with the input terminal In. A second terminal of the first light emission element 252 (e.g., the cathod) is coupled with the second power terminal Pw2 to receive the system low voltage OVSS from the second power terminal Pw2. In this embodiment, the system high voltage OVDD is higher than the system low voltage OVSS.

In practice, the first driving transistor 2122, the second driving transistor 2142, and a plurality of switches of FIG. 2 may be realized by various suitable P-type transistors. For example, the thin-film transistor (TFT), the field effect transistor (FET), or the biopolar junction transistor (BJT).

In addition, the light emission elements in this disclosure may be realized by the organic light-emitting diode (OLED) or by the micro LED.

Figure 3:
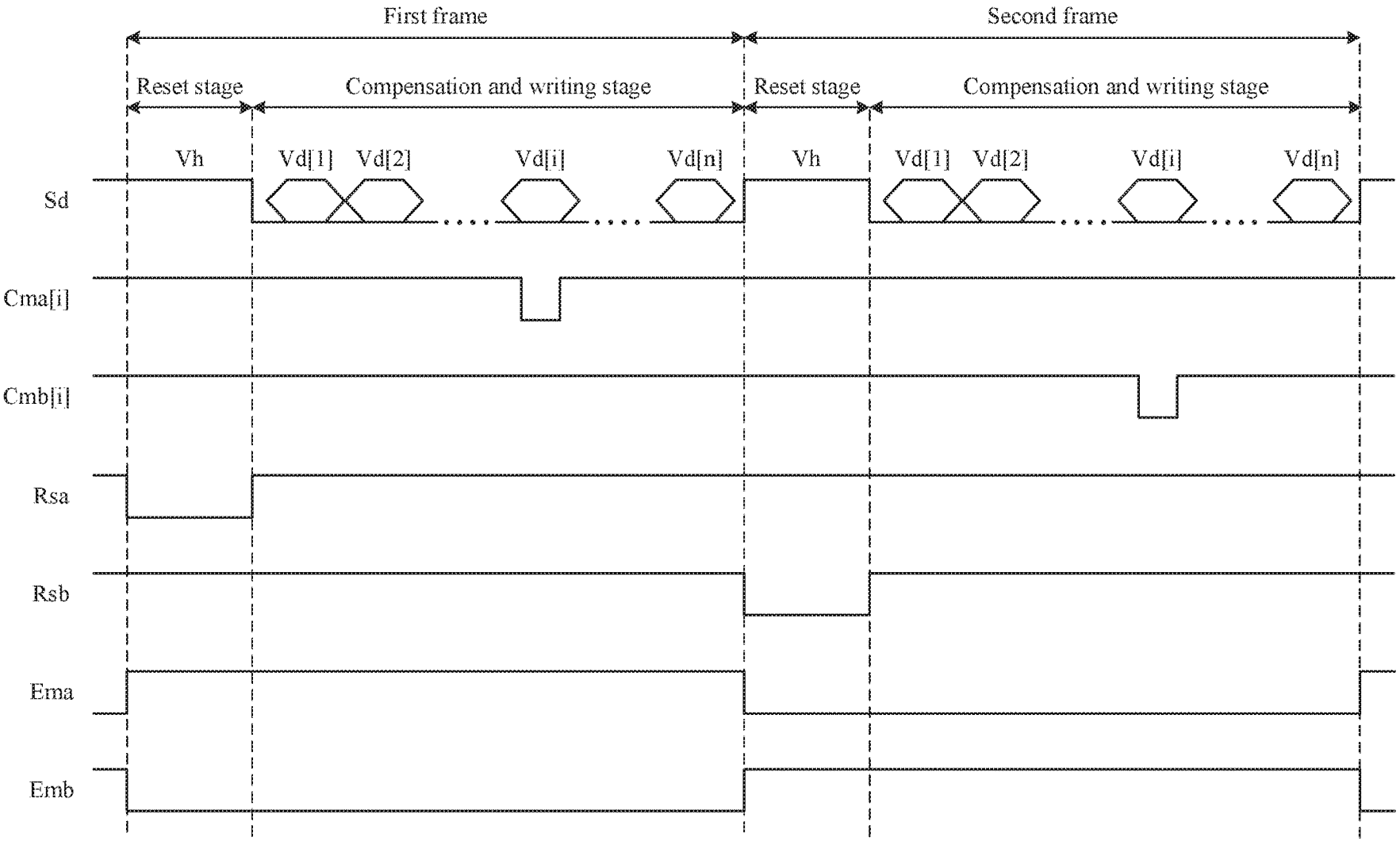
FIG. 3 is a simplified waveform schematic for illustrating the control signals provided to the pixel circuit of FIG. 2.
Figure 4A:
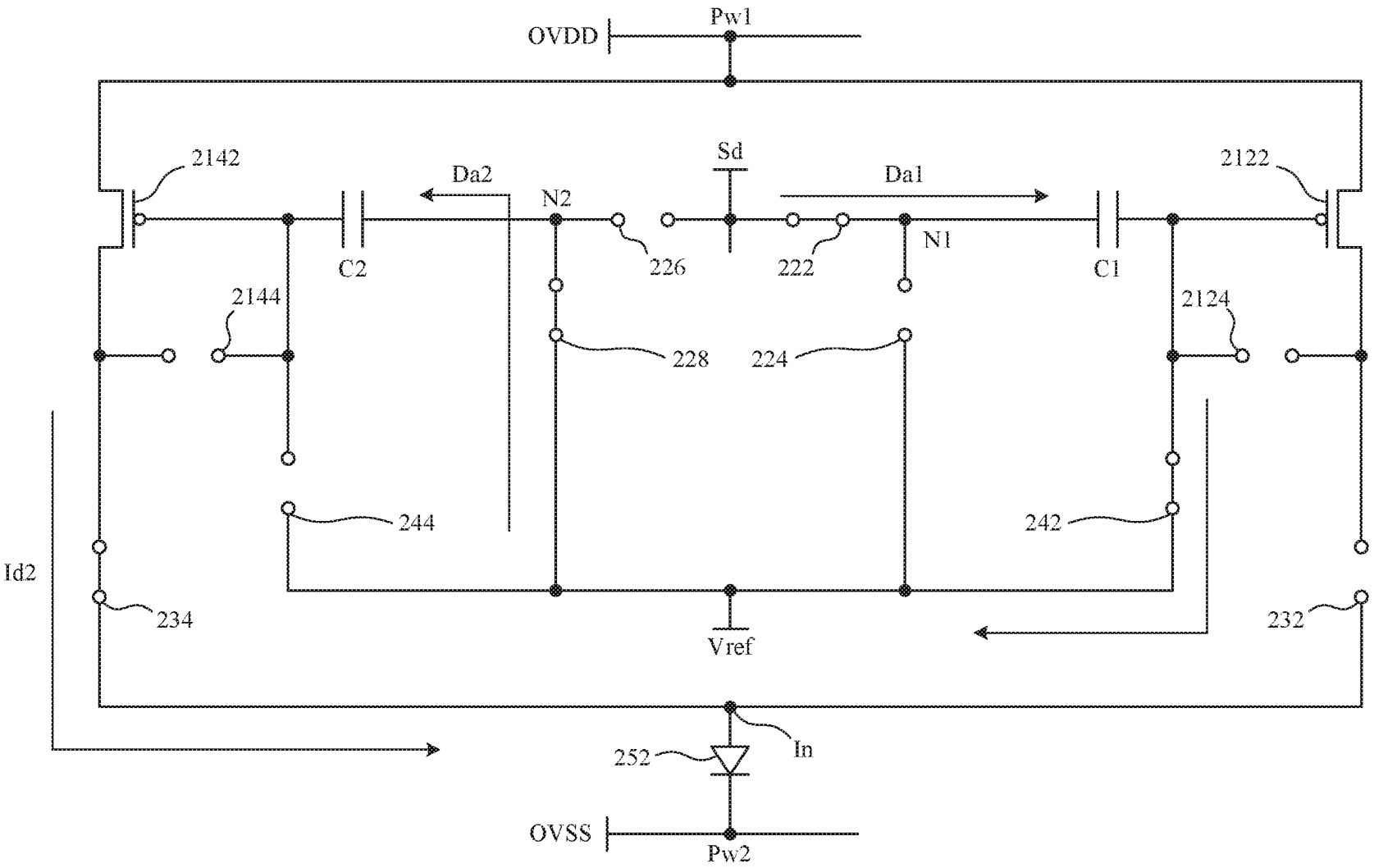
FIG. 4A is a schematic diagram for illustrating equivalent circuit operation of the pixel circuit of FIG. 2 in a reset stage of the first frame.
Figure 4B:
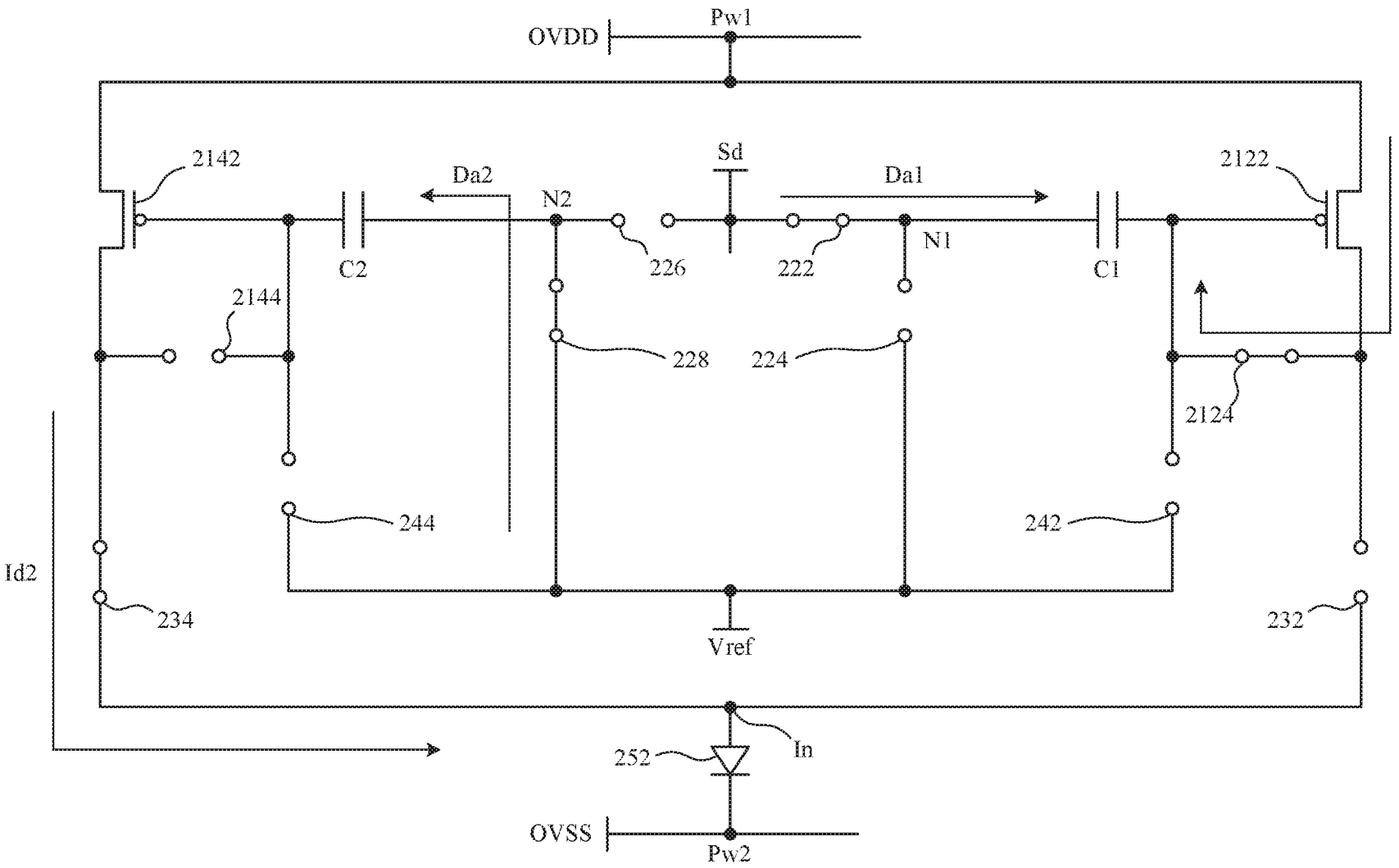
FIG. 4B is a schematic diagram for illustrating equivalent circuit operation of the pixel circuit of FIG. 2 in a compensation and writing stage of the first frame.
Figure 4C:
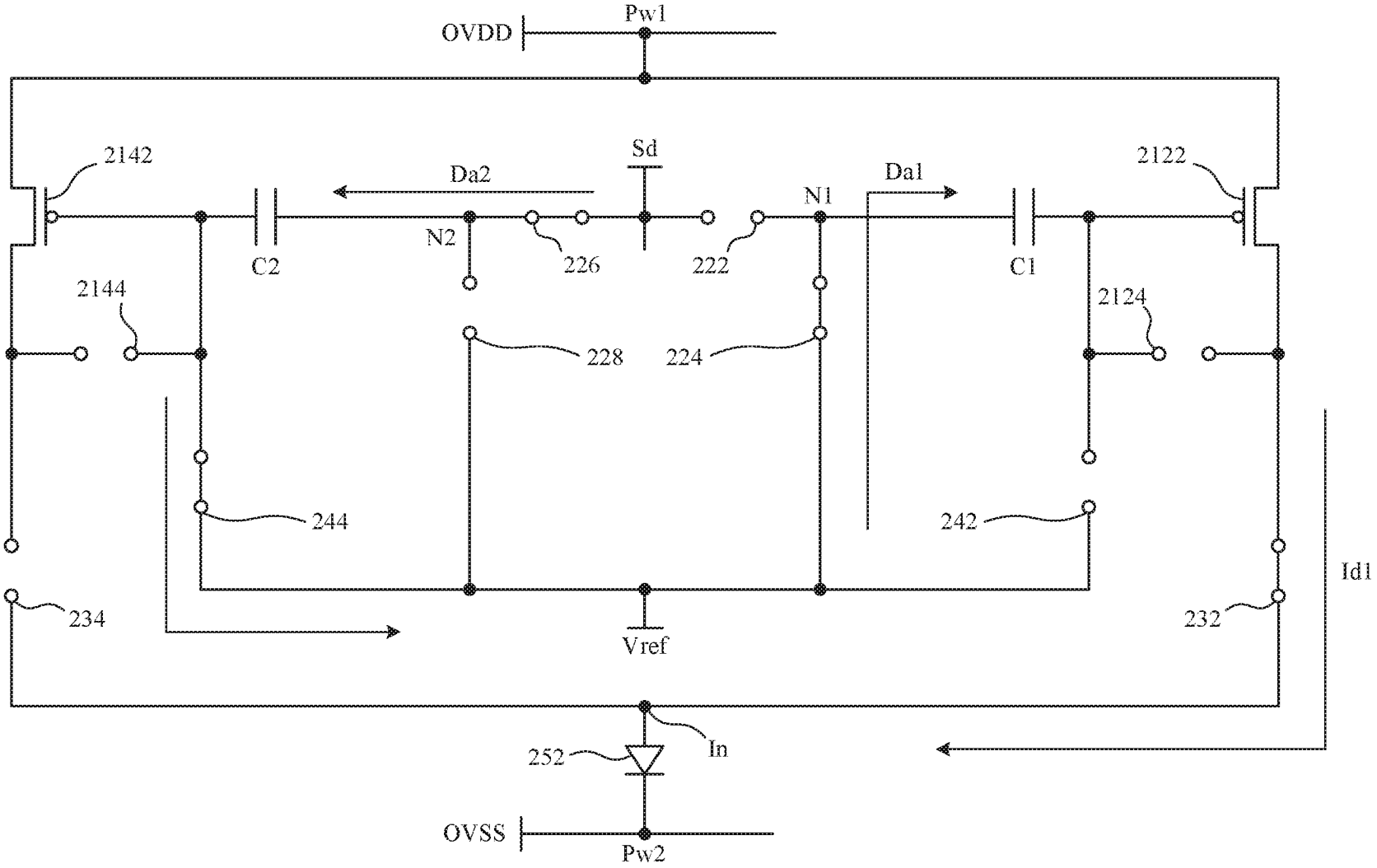
FIG. 4C is a schematic diagram for illustrating equivalent circuit operation of the pixel circuit of FIG. 2 in a reset stage of the second frame.
Figure 4D:
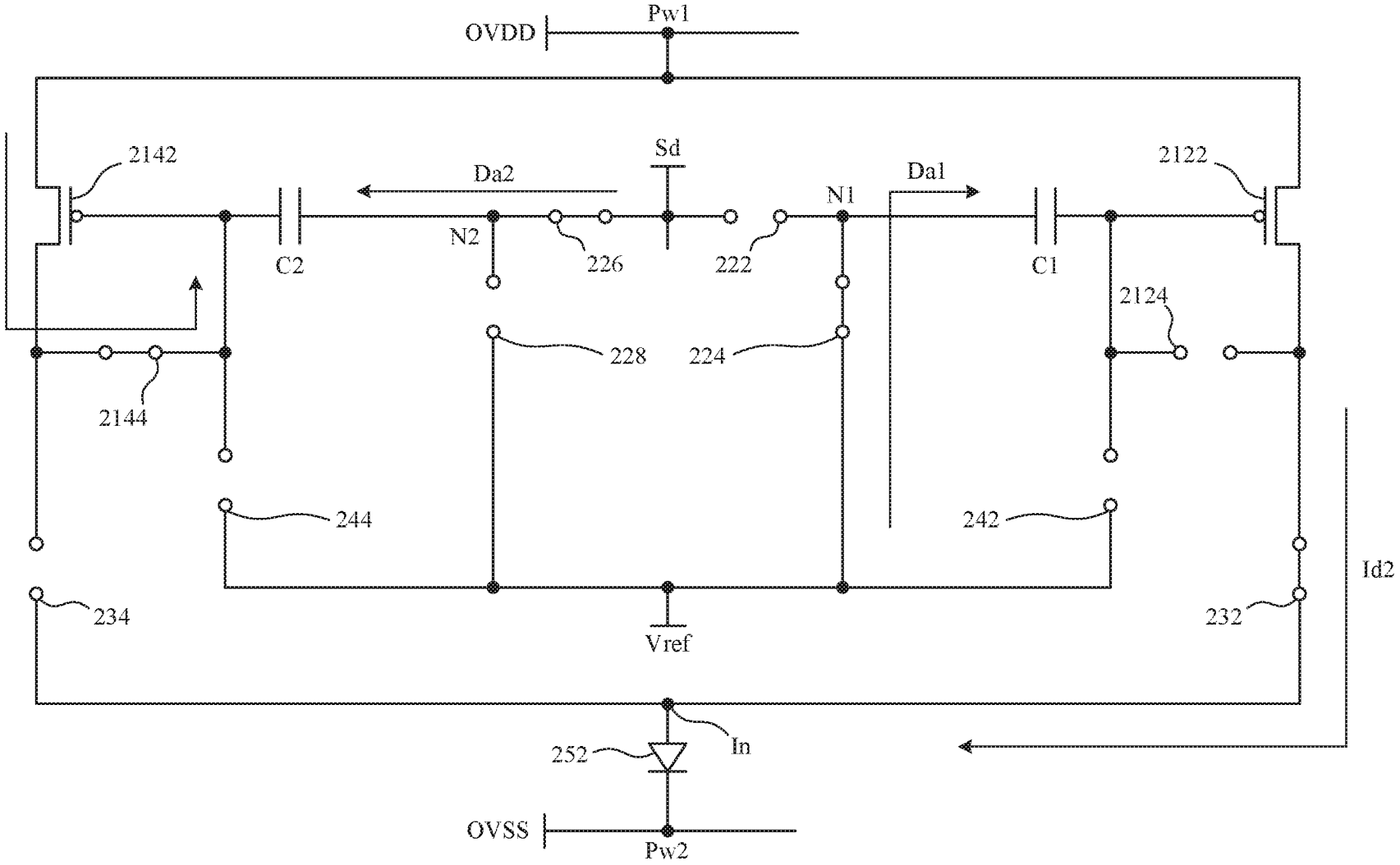
FIG. 4D is a schematic diagram for illustrating equivalent circuit operation of the pixel circuit of FIG. 2 in a compensation and writing stage of the second frame.

FIG. 3 is a simplified waveform schematic for illustrating the control signals provided to the pixel circuit 200. FIG. 4A is a schematic diagram for illustrating equivalent circuit operation of the pixel circuit 200 in a reset stage of the first frame. FIG. 4B is a schematic diagram for illustrating equivalent circuit operation of the pixel circuit 200 in a compensation and writing stage of the first frame. FIG. 4C is a schematic diagram for illustrating equivalent circuit operation of the pixel circuit 200 in a reset stage of the second frame. FIG. 4D is a schematic diagram for illustrating equivalent circuit operation of the pixel circuit 200 in a compensation and writing stage of the second frame.

As shown in FIG. 3, the operation of the pixel circuit 200 in each frame comprises the reset stage as well as the compensation and writing stage. The first scan signal Cma[i], the second scan signal Cmb[i], the first reset signal Rsa, the second reset signal Rsb, the first emission signal Ema, and the second emission signal Emb are periodical signals each have a period of two frames. The display signal Sd provides the holding voltage Vh in each reset stage, and provides a plurality of data voltages Vd[1]~Vd[n] in each compensation and writing stage, wherein n is a positive integer. In addition, the first emission signal Ema is opposite to the second emission signal Emb.

Reference is now made to FIGS. 3 and 4A, in the reset stage of the first frame, the first reset signal Rsa and the second emission signal Emb have logic high level (e.g., low voltage that conducts the P-type transistor); the first scan signal Cma[i], the second scan signal Cmb[i], the second reset signal Rsb, and the first emission signal Ema have logic low level (e.g., high voltage that switches off the P-type transistor). The first driving transistor 2122, the second driving transistor 2142, the second emission switch 234, the first writing switch 222, the fourth writing switch 228, the first reset switch 242 are conducted, and other switches in the pixel circuit 200 are switched off.

The second driving transistor 2142 is operated in the saturation region, and determines magnitude of the second driving current Id2 according to the voltage of the control terminal of the second driving transistor 2142. The second driving current Id2 flows through the second emission switch 234 and the input terminal In to the first light emission element 252 so that the first light emission element 252 emits light. The control terminal of the first driving transistor 2122 is set to the reference voltage Vref. The writing circuit 220 outputs the holding voltage Vh as the first data signal Da1, and outputs the reference voltage Vref as the second data signal Da2.

Reference is made to FIGS. 3 and 4B, in the compensation and writing stage of the first period, the first scan signal Cma[i] provides a pulse having the logic high level while remains the logic low level at times other than the pulse duration of the pulse; the second emission signal Emb has the logic high level; the second scan signal Cmb[i], the first reset signal Rsa, the second reset signal Rsb, and the first emission signal Ema has logic low level. The first driving transistor 2122, the second driving transistor 2142, the second emission switch 234, the first writing switch 222, and the fourth writing switch 228 are conducted, the first compensation switch 2124 is conducted when the first scan signal Cma[i] providing the pulse, and other switches in the pixel circuit 200 are switched off.

Therefore, the first light emission element 252 keeps emitting light according to the second driving current Id2. The writing circuit 220 outputs the data voltages Vd[1]~Vd[n] as the first data signal Da1, and outputs the reference voltage Vref as the second data signal Da2. The first compensation unit 212 stores a corresponding one of the data voltages Vd[1]~Vd[n] (e.g., the data voltage Vd[i]), and the first compensation unit 212 detects the characteristic of the first driving transistor 2122.

In specific, when the first scan signal Cma[i] provides the pulse having the logic high level, the first compensation switch 2124 are switched to a conducted state so that the first driving transistor 2122 forms a diode-connected transistor. The control terminal of the first driving transistor 2122 is set to a voltage described in Formula 1.

$$Vg1=OVDD-|Vth1| \quad \text{(Formula 1)}$$

With respect to Formula 1, label "Vg1" represents the voltage of the control terminal of the first driving transistor 2122; and label "Vth1" represents the threshold voltage of the first driving transistor 2122.

In other words, a terminal of the first capacitor C1 is set to the data voltage Vd[i], and the other terminal is set to the voltage described in Formula 1. When pulse of the first scan signal Cma[i] is finished and the first compensation switch 2124 is switched back to the switched-off state, even if the display signal Sd provides other data voltage different from the data voltage Vd[i], the voltage difference between the two terminals of the first capacitor C1 remains constant since the first capacitor C1 is floating.

Reference is made to FIGS. 3 and 4C, in the reset period of the second frame, the second reset signal Rsb and the first emission signal Ema have logic high level; the first scan signal Cma[i], the second scan signal Cmb[i], the first reset signal Rsa, and the second emission signal Emb have logic low level. The first driving transistor 2122, the second driving transistor 2142, the first emission switch 232, the second writing switch 224, the third writing switch 226, and the second reset switch 244 are conducted, while other switches in the pixel circuit 200 are switched off.

The control terminal of the second driving transistor 2142 is reset to the reference voltage Vref. The writing circuit 220 outputs the reference voltage Vref as the first data signal Da1, and outputs the holding voltage Vh as the second data signal Da2. The control terminal of the first driving transistor 2122 is changed to a voltage described in Formula 2 because of capacitive coupling. Therefore, the first driving transistor 2122 is operated in the saturation region and provides the first driving current Id1 as described in Formula 3 to the first light emission element 252.

$$Vg1=OVDD-|Vth1|+Vref-Vdata[i] \quad \text{(Formula 2)}$$

$$Id1=k(Vsg-|Vth1|)^2=k(Vdata[i]-Vref)^2 \quad \text{(Formula 3)}$$

With respect to Formula 3, label Vsg represents the voltage difference between the first terminal and the control terminal of the first driving transistor 2122. As can be appreciated from Formula 3, the first driving current Id1 is immune to the variation of the threshold voltage of the first driving transistor 2122.

Reference is made to FIGS. 3 and 4D, the second scan signal Cmb[i] provides a pulse have the logic high level while remains the logic low level at times other than the pulse duration of the pulse; the first emission signal Ema has logic high level; the first scan signal Cma[i], the first reset signal Rsa, the second reset signal Rsb, and the second emission signal Emb have logic low level. The first driving transistor 2122, the second driving transistor 2142, the first emission switch 232, the second writing switch 224, and the third writing switch 226 are conducted, the second compensation switch 2144 is conducted when the second scan signal Cmb[i] provides the pulse, while other switches in the pixel circuit 200 are switched off.

Therefore, the first light emission element 252 keeps emitting light according to the first driving current Id1. The writing circuit 220 outputs the reference voltage Vref as the first data signal Da1, and outputs the data voltages Vd[1]~Vd[n] as the second data signal Da2. The second compensation unit 214 stores a corresponding one of the data voltages Vd[1]~Vd[n] (e.g., the data voltage Vd[i]), and further detects the characteristics of the second driving transistor 2142. The corresponding operations of the first compensation unit 212 are also applicable to the second compensation unit 214. For the sake of brevity, those descriptions will not be repeated here.

As can be appreciated from the forgoing descriptions, the pixel circuit 200 provides stable brightness while updating internal node voltages, and need not to stop emitting for updating internal node voltages. Therefore, the pixel circuit 200 reduces flicker of images.

In addition, the light emitting efficiency of micro LED is negatively correlated to the value of driving current thereof. In one embodiment that the first light emission element 252 is realized by micro LED, the pixel circuit 200 compensates the light emitting efficiency of micro LED by the longer emission duration.

Figure 5:
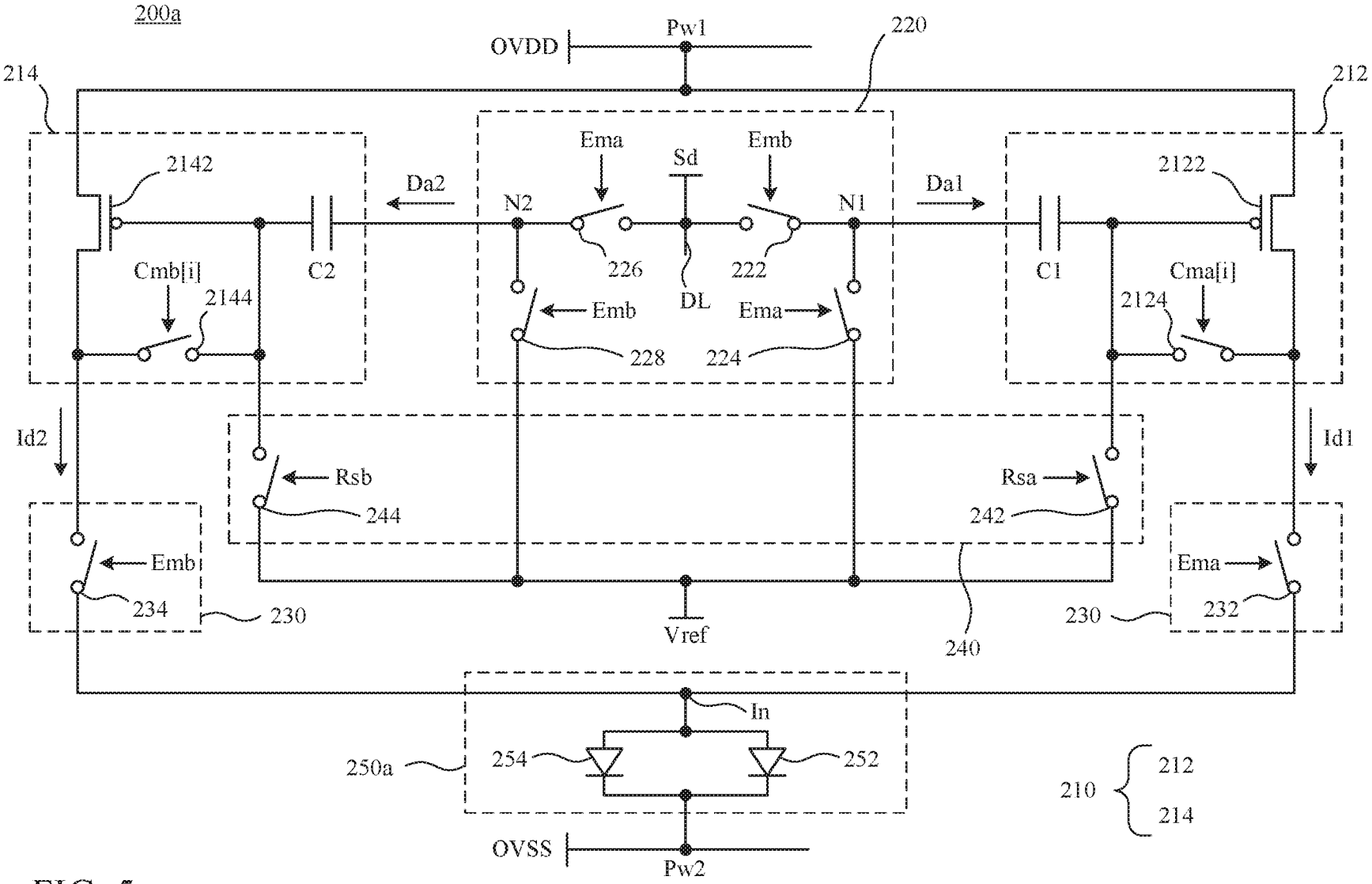
FIG. 5 is a functional block diagram of a pixel circuit according to one embodiment of the present disclosure.

FIG. 5 is a functional block diagram of a pixel circuit 200*a* according to one embodiment of the present disclosure. The pixel circuit 200*a* comprises the compensation circuit 210, the writing circuit 220, the light emission control circuit 230, the reset circuit 240, and a brightness control circuit 250*a*. The brightness control circuit 250*a* may be used to realize the brightness control circuit 150 of FIG. 1.

The brightness control circuit 250*a* comprises the input terminal In, the first light emission element 252, and a second light emission element 254. The input terminal In is coupled with the second terminal of the first emission switch 232 and the second terminal of the second emission switch 234 of the light emission control circuit 230. The first light emission element 252 and the second light emission element 254 are coupled with the input terminal In in a parallel connection by their first terminals (e.g., the anodes). The first light emission element 252 and the second light emission element 254 are coupled with the second power terminal Pw2 in a parallel connection by their second terminals (e.g., the cathodes).

In this embodiment, the first light emission element 252 and the second light emission element 254 may be the redundancy element for each other to increase the reliability of the pixel circuit 200*a*. The foregoing descriptions regarding the implementations, connections, operations, and related advantages of other corresponding functional blocks in the pixel circuit 200 are also applicable to the pixel circuit 200*a*. For the sake of brevity, those descriptions will not be repeated here.

Figure 6:
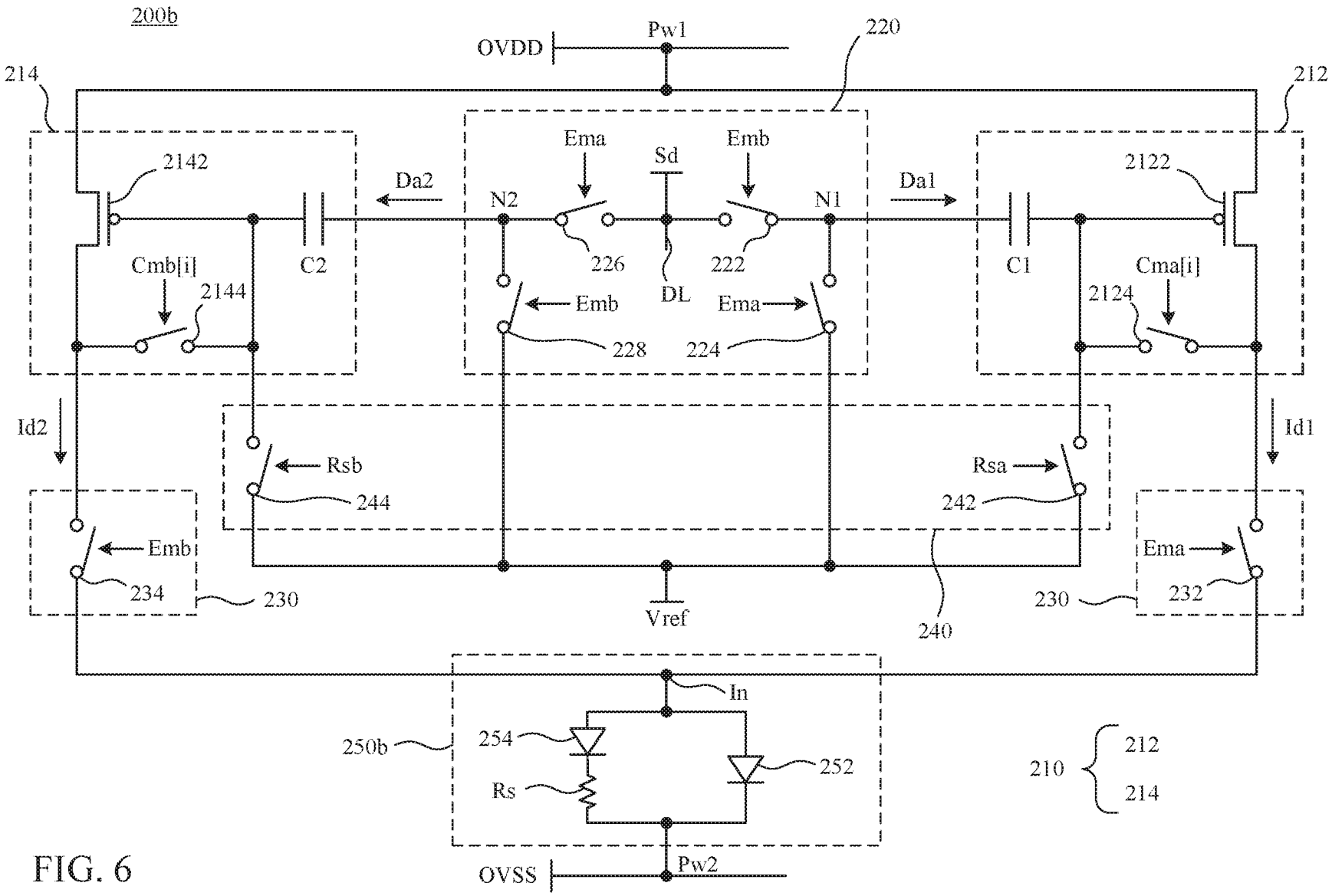
FIG. 6 is a functional block diagram of a pixel circuit according to one embodiment of the present disclosure.

FIG. 6 is a functional block diagram of a pixel circuit 200*b* according to one embodiment of the present disclosure. The pixel circuit 200*b* comprises the compensation circuit 210, the writing circuit 220, the light emission control circuit 230, the reset circuit 240, and a brightness control circuit 250*b*. The brightness control circuit 250*b* may be used to realize the brightness control circuit 150 of FIG. 1. The brightness control circuit 250*b* comprises the input terminal In, the first light emission element 252, the second light emission element 254, and a resistor element Rs. The input terminal In is coupled with the second terminal of the first emission switch 232 and the second terminal of the second emission switch 234 of the light emission control circuit 230. The first light emission element 252 and the second light emission element 254 is coupled with the input terminal In in a parallel connection by their first terminals. The second terminal of the first light emission element 252 is coupled with the second power terminal Pw2. The resistor element Rs is coupled between the second terminal of the second light emission element 254 and the second power terminal Pw2.

In this embodiment, the first light emission element 252 and the second light emission element 254 may be the redundancy element for each other to increase the reliability of the pixel circuit 200*b*. Since the output terminal of the second light emission element 254 has higher output impedance, the second light emission element 254 is disabled in the case that the first light emission element 252 is properly functioning, reducing power consumption of the pixel circuit 200*b*. The foregoing descriptions regarding the implementations, connections, operations, and related advantages of other corresponding functional blocks in the pixel circuit 200 are also applicable to the pixel circuit 200*b*. For the sake of brevity, those descriptions will not be repeated here.

Figure 7:
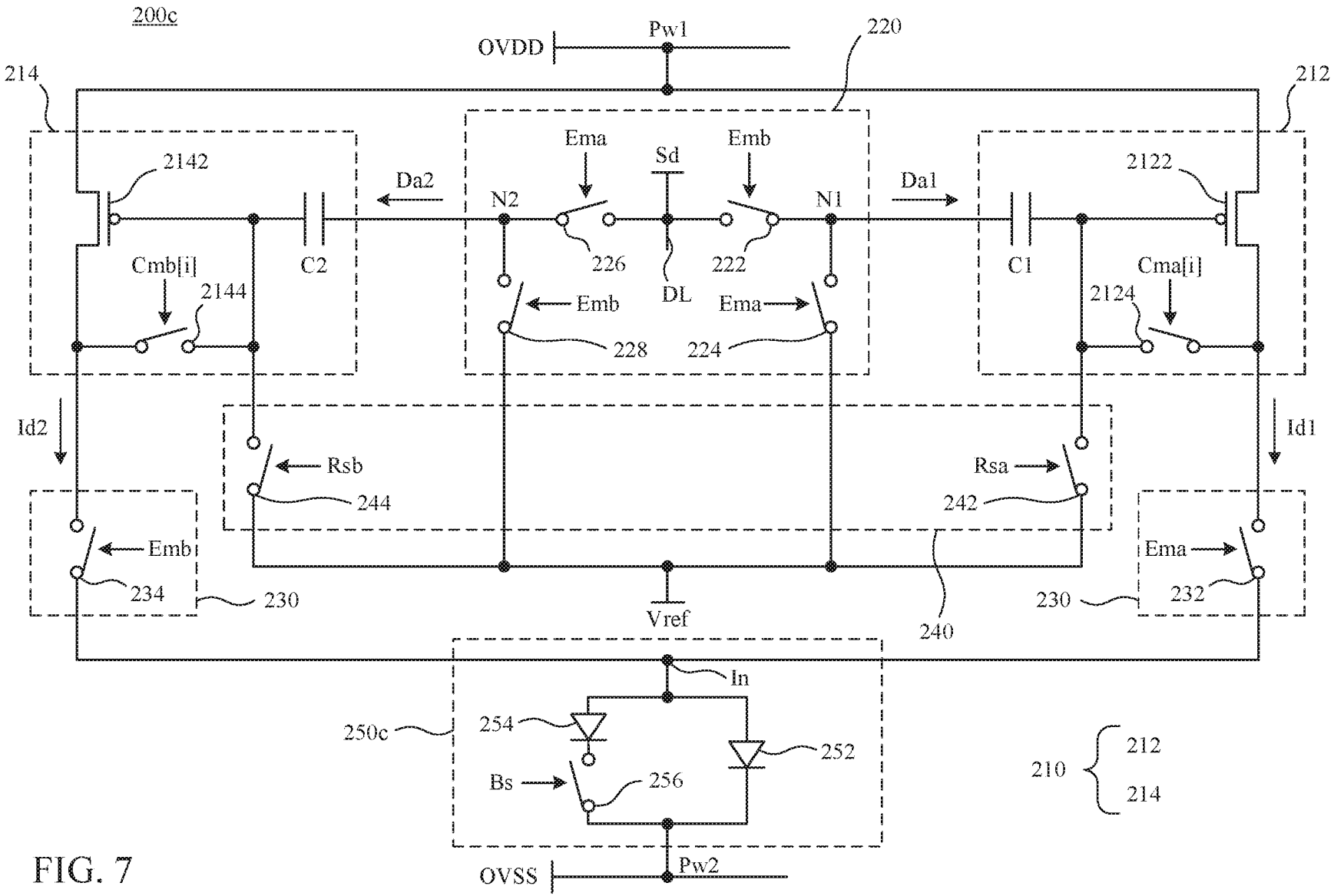
FIG. 7 is a functional block diagram of a pixel circuit according to one embodiment of the present disclosure.

FIG. 7 is a functional block diagram of a pixel circuit 200*c* according to one embodiment of the present disclosure. The pixel circuit 200*c* comprises the compensation circuit 210, the writing circuit 220, the light emission control circuit 230, the reset circuit 240, and a brightness control circuit 250*c*. The brightness control circuit 250*c* may be used to realize the brightness control circuit 150 of FIG. 1. The brightness control circuit 250*c* comprises the input terminal In, the first light emission element 252, the second light emission element 254, and a bypass switch 256. The first light emission element 252 and the second light emission element 254 are coupled with the input terminal In in a parallel connection by their first terminals. The second terminal of the first light emission element 252 is coupled with the second power terminal Pw2. The bypass switch 256 comprises a first terminal, a second terminal, and a control terminal. The first terminal and the second terminal of the bypass switch 256 are coupled with the second terminal of the second light emission element 254 and the second power terminal Pw2, respectively. The control terminal of the bypass switch 256 is configured to receive the bypass signal Bs.

In this embodiment, the first light emission element 252 and the second light emission element 254 may be the redundancy element for each other to increase the reliability of the pixel circuit 200*c*. In the case that the first light emission element 252 is properly functioning, the bypass switch 256 may be switched off to reduce the power consumption of the pixel circuit 200*c*. On the other hand, if the first light emission element 252 is damaged and forms an open circuit, the bypass switch 256 may be conducted. The bypass signal Bs may be generated by the timing controller (e.g., the timing control circuit 310 of FIG. 11). The foregoing descriptions regarding the implementations, connections, operations, and related advantages of other corresponding functional blocks in the pixel circuit 200 are also applicable to the pixel circuit 200*c*. For the sake of brevity, those descriptions will not be repeated here.

Figure 8:
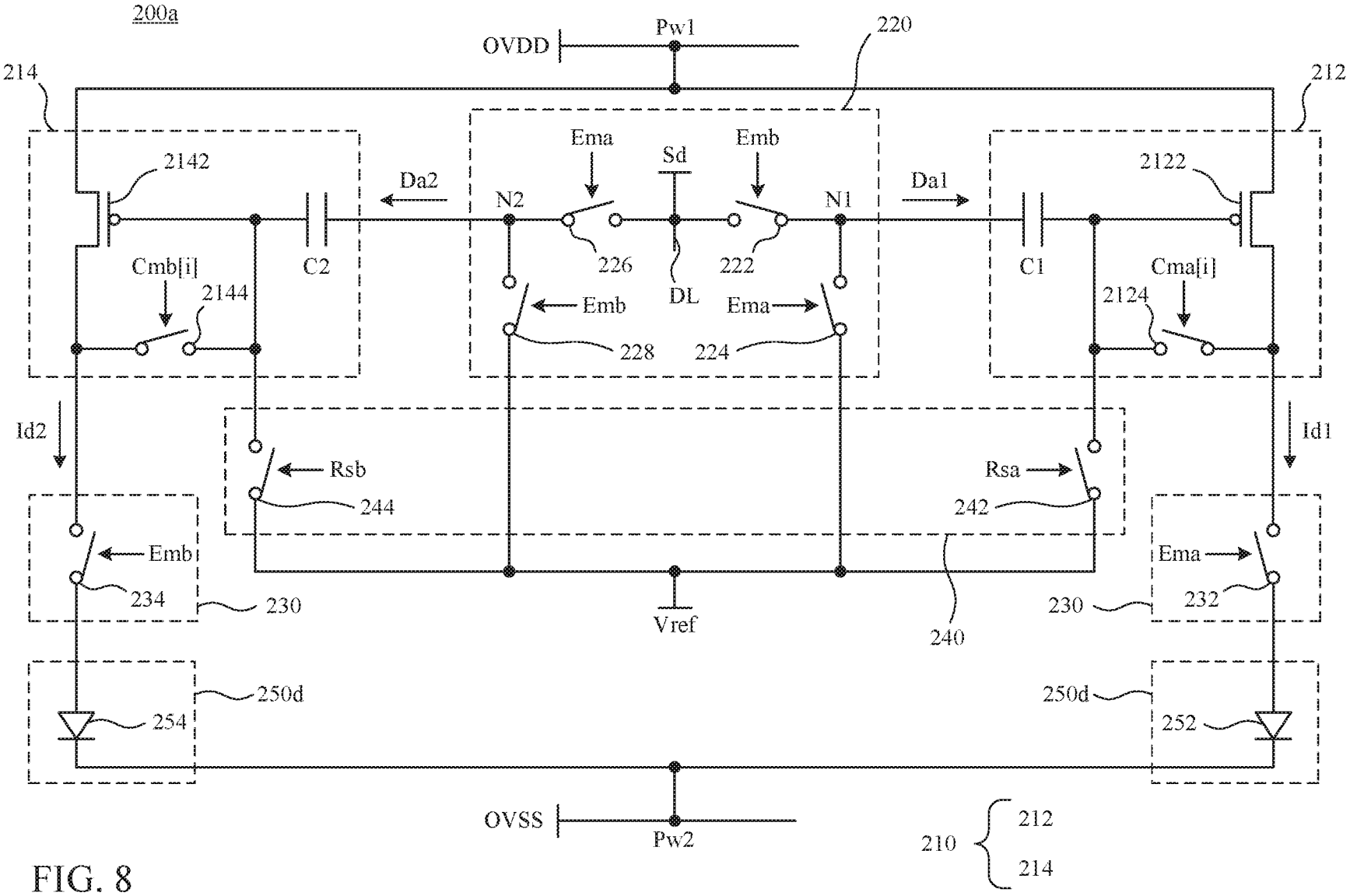
FIG. 8 is a functional block diagram of a pixel circuit according to one embodiment of the present disclosure.

FIG. 8 is a functional block diagram of a pixel circuit 200*d* according to one embodiment of the present disclosure. The pixel circuit 200*d* comprises the compensation circuit 210, the writing circuit 220, the light emission control circuit 230, the reset circuit 240, and the brightness control circuit 250*d*. The brightness control circuit 250*d* may be used to realize the brightness control circuit 150 of FIG. 1. The brightness control circuit 250*d* comprises the first light emission element 252 and the second light emission element 254. The first terminal of the first light emission element 252 is coupled with the second terminal of the first emission switch 232. The first terminal of the second light emission element 254 is coupled with the second terminal of the second emission switch 234. The second terminal of the first light emission element 252 and the second terminal of the second light emission element 254 are coupled with the second power terminal Pw2 in a parallel connection.

In other words, the first light emission element 252 and the second light emission element 254 are configured to receive the first driving current Id1 and the second driving current Id2, respectively, from the light emission control circuit 230.

In this embodiment, the first light emission element 252 and the second light emission element 254 alternately emit light, thereby increasing the operating life of each other and also increasing the reliability of the pixel circuit 200*d*. The foregoing descriptions regarding the implementations, connections, operations, and related advantages of other corresponding functional blocks in the pixel circuit 200 are also applicable to the pixel circuit 200*d*. For the sake of brevity, those descriptions will not be repeated here.

Figure 9:
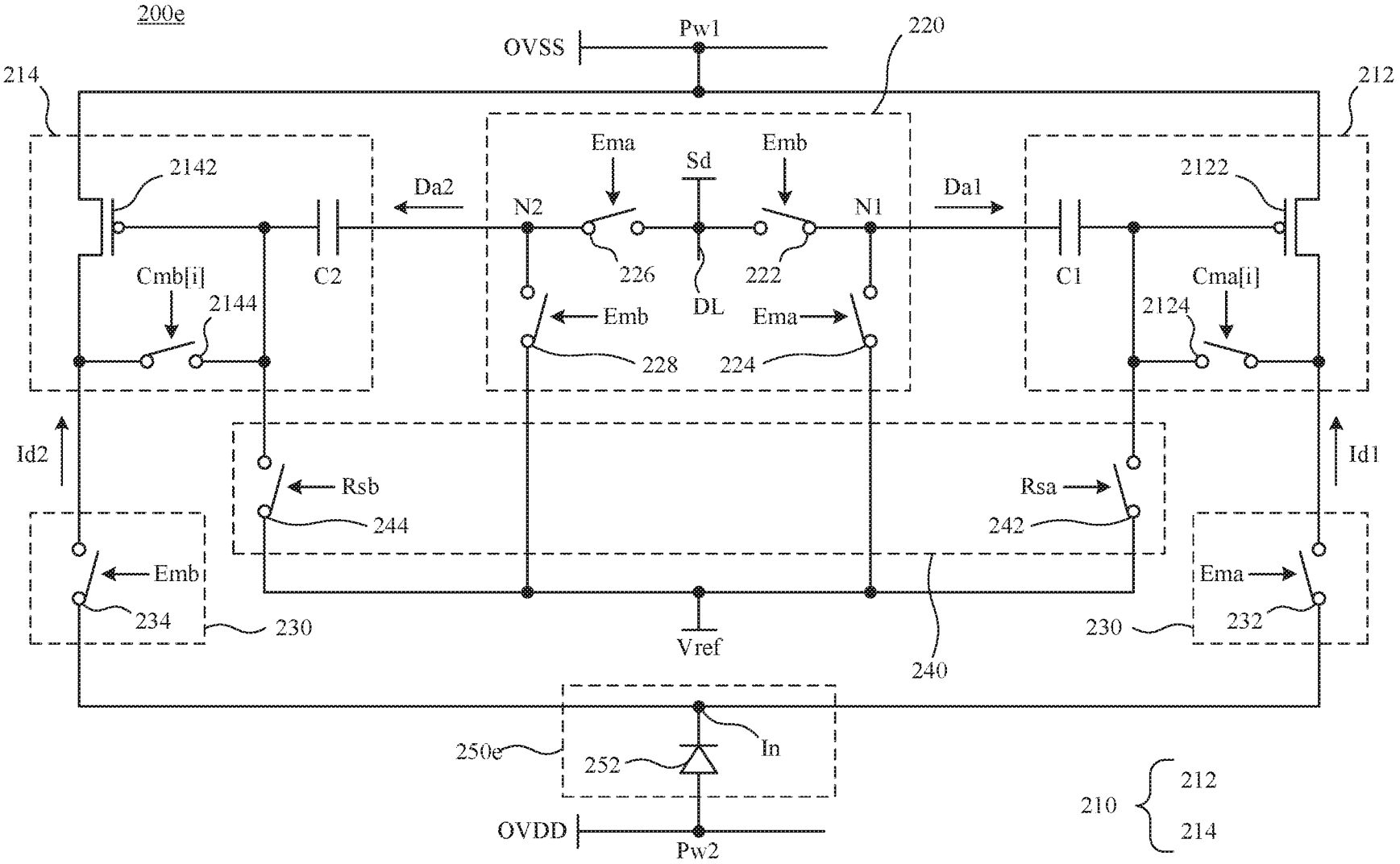
FIG. 9 is a functional block diagram of a pixel circuit according to one embodiment of the present disclosure.
Figure 10:
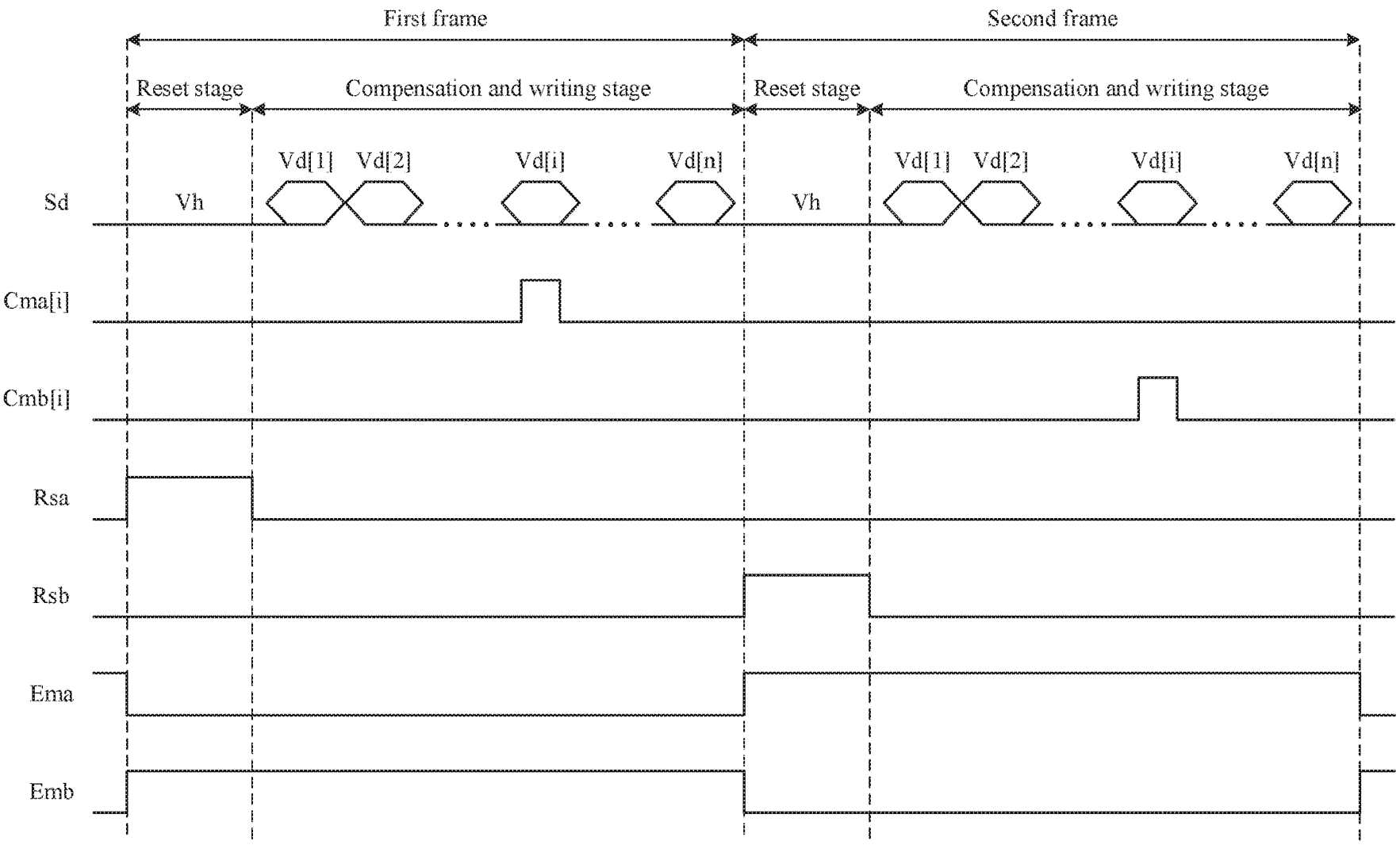
FIG. 10 is a simplified waveform schematic for illustrating the control signals provided to the pixel circuit of FIG. 9.

FIG. 9 is a functional block diagram of a pixel circuit 200*e* according to one embodiment of the present disclosure. FIG. 10 is a simplified waveform schematic for illustrating the control signals provided to the pixel circuit 200*e*. The pixel circuit 200*e* comprises the compensation circuit 210, the writing circuit 220, the light emission control circuit 230, the reset circuit 240, and a brightness control circuit 250*e*. The brightness control circuit 250*e* may be used to realize the brightness control circuit 150 of FIG. 1. The first driving transistor 2122, the second driving transistor 2142 and all switches of the pixel circuit 200*e* may be realized by N-type transistors. The brightness control circuit 250*e* comprises the first light emission element 252 and the input terminal In, and the first light emission element 252 comprises the first terminal (e.g., the anode) and the second terminal (e.g., the cathode). The first terminal of the first light emission element 252 is coupled with the second power terminal Pw2. The second terminal of the first light emission element 252 is coupled with the input terminal In.

Reference is made to FIGS. 9 and 10, the first power terminal Pw1 is configured to provide the system low voltage OVSS, and the second power terminal Pw2 is configured to provide the system high voltage OVDD, wherein the system high voltage OVDD is higher than the system low voltage OVSS. In the compensation and writing period of the first frame, the first driving current Id1 flows, from the second power terminal Pw2 to the first power terminal Pw1, through the first light emission element 252, the first emission switch 232, and the first driving transistor 2122 in sequence. In the compensation and writing period of the second frame, the second driving current Id2 flows, from the second power terminal Pw2 to the first power terminal Pw1, through the first light emission element 252, the second emission switch 234, and the second driving transistor 2142.

In other words, when the first light emission element 252 emits light, one of the first driving current Id1 and the second driving current Id2 flows, from the second power terminal Pw2 to the first power terminal Pw1, through the brightness control circuit 250*e*, the light emission control circuit 230, and the compensation circuit 210 in sequence. The foregoing descriptions regarding the implementations, connections, operations, and related advantages of other corresponding functional blocks in the pixel circuit 200 are also applicable to the pixel circuit 200*e*. For the sake of brevity, those descriptions will not be repeated here.

Figure 11:
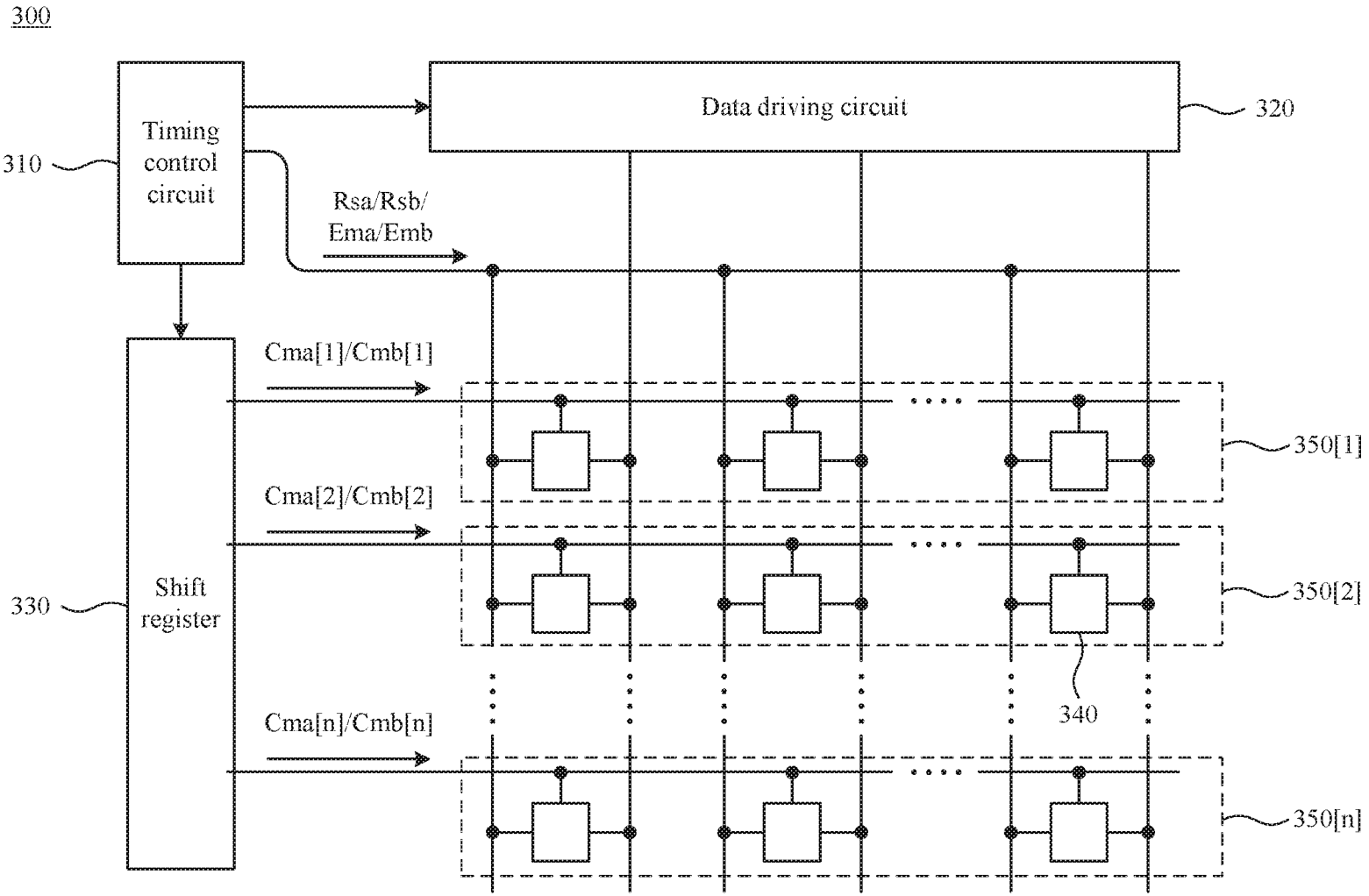
FIG. 11 is a simplified functional block diagram of a display panel according to one embodiment of the present disclosure.
Figure 12:
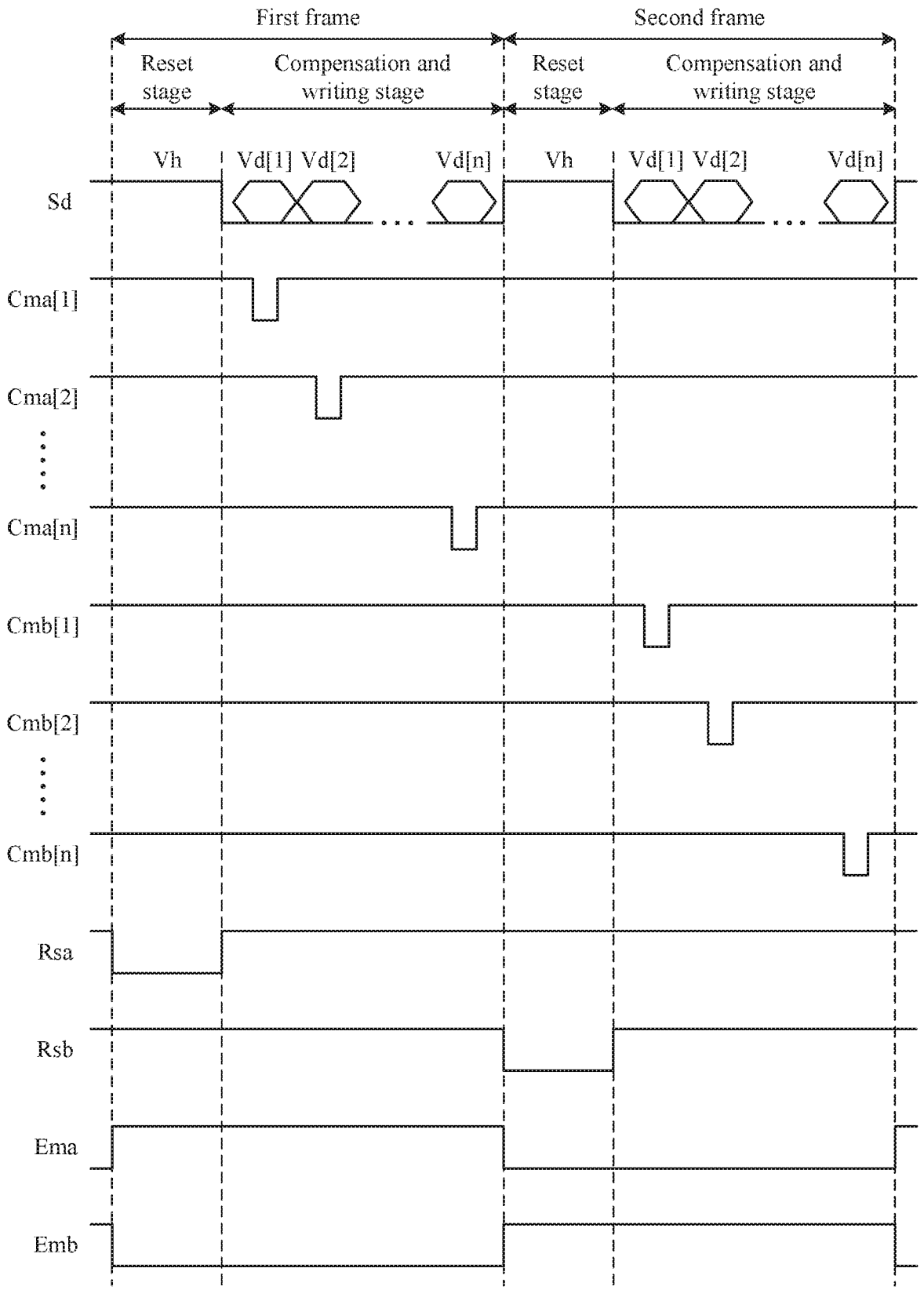
FIG. 12 is a simplified waveform schematic for illustrating the control signals provided to the display panel of FIG. 11.

FIG. 11 is a simplified functional block diagram of a display panel 300 according to one embodiment of the present disclosure. FIG. 12 is a simplified waveform schematic for illustrating the control signals provided to the display panel 300. The display panel 300 comprises a timing control circuit 310, a data driving circuit 320, a shift register 330, and a plurality of pixel circuits 340.

Reference is made to FIGS. 11 and 12. The timing control circuit 310 is configured to receive a vertical sync signal (Vsync), a horizontal sync signal (Hsync), and RGB data, and is also configured to output clock signals, enable signals, and display data for driving the data driving circuit 320 and the shift register 330. The shift register 330 is configured to output the first scan signals Cma[1]~Cma[n] and the second scan signals Cmb[1]~Cmb[n] which change one after one (e.g., successively provide pulses), and n is a positive integer. The timing control circuit 310 is configured to output the first reset signal Rsa, the second reset signal Rsb, the first emission signal Ema, and the second emission signal Emb which need not to change one after one.

In some embodiments, the timing control circuit 310 and the data driving circuit 320 may be disposed in a single chip (e.g., display driver integrated circuit, DDIC). In other embodiments, the timing control circuit 310 and the data driving circuit 320 are disposed on FPCB (not shown in FIG. 11), and the shift register 330 and the plurality of pixel circuits 340 are disposed on the glass substrate (not shown in FIG. 11). In yet other embodiments, the timing control circuit 310, the data driving circuit 320, the shift register 330, and the plurality of pixel circuits 340 are all disposed on the glass substrate.

The plurality of pixel circuits 340 forms a plurality of pixel rows 350[1]~350[*n*]. Each of the pixel circuit 340 may be realized by one of the pixel circuits of the above embodiments. For instance, a pixel circuit 340 located at the pixel row 350[*i*] may receive the first scan signal Cma[i] and the second scan signal Cmb[i] from the shift register 330, and may receive the first reset signal Rsa, second reset signal Rsb, the first emission signal Ema, and the second emission signal Emb from the timing control circuit 310, wherein i is a positive integer smaller than or equal to n. In addition, the display signal Sd of the above embodiments may be outputted by the data driving circuit 320 to the pixel circuit 340.

As can be appreciated from the foregoing descriptions, the display panel 300 needs not to comprise a plurality of sets of shift registers for generating different types of control signals with very different pulse widths. Therefore, the borderless design can be applied to multiple borders of the display panel 300, and thus the display panel 300 is suitable for the splicing application which has strict requirements toward the border thickness.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The term "couple" is intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

In addition, the singular forms "a," "an," and "the" herein are intended to comprise the plural forms as well, unless the context clearly indicates otherwise.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A pixel circuit, comprising:

a writing circuit, configured to provide a first data signal and a second data signal;

a compensation circuit, comprising a first compensation circuit and a second compensation circuit, wherein the first compensation circuit is configured to provide, in a first time period, a first driving current according to the first data signal, the second compensation circuit is configured to provide, in a second time period, a second driving current according to the second data signal, and the first time period is separated from the second time period, wherein the first compensation circuit comprises:

a first driving transistor, comprising a first terminal, a second terminal, and a control terminal;

a first compensation switch, comprising a first terminal, a second terminal, and a control terminal, wherein the first terminal of the first compensation switch is coupled with the control terminal of the first driving transistor, the second terminal of the first compensation switch is coupled with the second terminal of the first driving transistor, and the control terminal of the first compensation switch is configured to receive a first scan signal; and a first capacitor, coupled between the writing circuit and the control terminal of the first driving transistor, and configured to receive the first data signal, wherein the second compensation circuit comprises:

a second driving transistor, comprising a first terminal, a second terminal, and a control terminal;

a second compensation switch, comprising a first terminal, a second terminal, and a control terminal, wherein the first terminal of the second compensation switch is coupled with the control terminal of the second driving transistor, the second terminal of the second compensation switch is coupled with the second terminal of the second driving transistor, and the control terminal of the second compensation switch is configured to receive a second scan signal; and a second capacitor, coupled between the writing circuit and the control terminal of the second driving transistor, and configured to receive the second data signal, wherein the first terminal of the first driving transistor and the first terminal of the second driving transistor are coupled, in a parallel connection, with a first power terminal;

a reset circuit, configured to provide a reference voltage to the compensation circuit;

a brightness control circuit; and a light emission control circuit, coupled with the first compensation circuit, the second compensation circuit, and the brightness control circuit, wherein the light emission control circuit conducts, in the first time period, the first compensation circuit to the brightness control circuit so that the brightness control circuit emits according to the first driving current, and the light emission control circuit conducts, in the second time period, the second compensation circuit to the brightness control circuit so that the brightness control circuit emits according to the second driving current.

2. The pixel circuit of claim 1, wherein the light emission control circuit comprises:

a first emission switch, comprising a first terminal, a second terminal, and a control terminal, wherein the first terminal of the first emission switch is coupled with the first compensation circuit, and the control terminal of the first emission switch is configured to receive a first emission signal; and a second emission switch, comprising a first terminal, a second terminal, and a control terminal, wherein the first terminal of the second emission switch is coupled with the second compensation circuit, and the control terminal of the second emission switch is configured to receive a second emission signal, wherein the second terminal of the first emission switch and the second terminal of the second emission switch are coupled, in a parallel connection, with the brightness control circuit.

3. The pixel circuit of claim 1, wherein the reset circuit comprises:

a first reset switch, comprising a first terminal, a second terminal, and a control terminal, wherein the first terminal of the first reset switch is coupled with the first compensation circuit, and the control terminal of the first reset switch is configured to receive a first reset signal; and a second reset switch, comprising a first terminal, a second terminal, and a control terminal, wherein the first terminal of the second reset switch is coupled with the second compensation circuit, and the control terminal of the second reset switch is configured to receive a second reset signal, wherein the second terminal of the first reset switch and the second terminal of the second reset switch are configured to receive the reference voltage.

4. The pixel circuit of claim 1, wherein the writing circuit comprises:

a first node, configured to provide the first data signal;

a first writing switch, comprising a first terminal, a second terminal, and a control terminal;

a second writing switch, comprising a first terminal, a second terminal, and a control terminal, wherein the first terminal of the first writing switch and the first terminal of the second writing switch are coupled with the first node;

a second node, configured to provide the second data signal;

a third writing switch, comprising a first terminal, a second terminal, and a control terminal; and a fourth writing switch, comprising a first terminal, a second terminal, and a control terminal, wherein the first terminal of the third writing switch and the first terminal of the fourth writing switch are coupled with the second node, wherein the second terminal of the first writing switch and the second terminal of the third writing switch are coupled with a data line, and the second terminal of the second writing switch and the second terminal of the fourth writing switch are configured to receive the reference voltage, the control terminal of the first writing switch and the control terminal of the fourth writing switch are configured to receive a first emission signal, and the control terminal of the second writing switch and the control terminal of the third writing switch are configured to receive a second emission signal.

5. The pixel circuit of claim 4, wherein the first emission signal is opposite to the second emission signal.

6. The pixel circuit of claim 4, wherein the writing circuit is configured to receive a plurality of data voltages from the data line, when the writing circuit outputs the reference voltage as the first data signal, the writing circuit outputs the plurality of data voltages as the second data signal and the second compensation circuit determines magnitude of the second driving current according to a corresponding one of the plurality of data voltages.

7. The pixel circuit of claim 1, wherein the brightness control circuit comprises:

an input terminal, coupled with the light emission control circuit, and configured to receive the first driving current or the second driving current;

a first light emission element; and a second light emission element, wherein a first terminal of the first light emission element and a first terminal of the second light emission element are coupled, in a parallel connection, with the input terminal.

8. The pixel circuit of claim 7, wherein the brightness control circuit further comprises a resistor element, the resistor element is coupled between a second terminal of the second light emission element and a second power terminal, and a second terminal of the first light emission element is coupled with the second power terminal.

9. The pixel circuit of claim 7, wherein the brightness control circuit further comprises:

a bypass switch, comprising a first terminal, a second terminal, and a control terminal, wherein the first terminal of the bypass switch is coupled with a second terminal of the second light emission element, the second terminal of the bypass switch is coupled with a second power terminal, wherein a second terminal of the first light emission element is coupled with the second power terminal.

10. The pixel circuit of claim 1, wherein the brightness control circuit comprises:

a first light emission element; and a second light emission element, wherein the first light emission element and the second light emission element are configured to receive the first driving current and the second driving current, respectively, from the light emission control circuit.

11. The pixel circuit of claim 1, wherein the compensation circuit is coupled between the first power terminal and the light emission control circuit, the brightness control circuit is coupled between a second power terminal and the light emission control circuit, when the brightness control circuit emits, one of the first driving current and the second driving current flows, from the first power terminal to the second power terminal, through the compensation circuit, the light emission control circuit, and the brightness control circuit in sequence.

12. The pixel circuit of claim 1, wherein the compensation circuit is coupled between the first power terminal and the light emission control circuit, the brightness control circuit is coupled between a second power terminal and the light emission control circuit, when the brightness control circuit emits, one of the first driving current and the second driving current flows, from the second power terminal to the first power terminal, through the brightness control circuit, the light emission control circuit, and the compensation circuit in sequence.

13. A display panel, comprising:

a shift register, configured to provide a plurality of first scan signals and a plurality of second scan signals;

a timing control circuit, configured to output a first emission signal and a second emission signal; and a plurality of pixel circuit, coupled with the shift register and the timing control circuit, wherein each of the plurality of pixel circuit comprises:

a writing circuit, configured to provide a first data signal and a second data signal;

a compensation circuit, comprising a first compensation circuit and a second compensation circuit, wherein the first compensation circuit is configured to store, in a first time period, the first data signal according to a corresponding one of the plurality of first scan signals to provide a first driving current, the second compensation circuit is configured to store, in a second time period, the second data signal according to a corresponding one of the plurality of second scan signals to provide a second driving current, and the first time period is separated from the second time period, wherein the first compensation circuit comprises:

a first driving transistor, comprising a first terminal, a second terminal, and a control terminal;

a first compensation switch, comprising a first terminal, a second terminal, and a control terminal, wherein the first terminal of the first compensation switch is coupled with the control terminal of the first driving transistor, the second terminal of the first compensation switch is coupled with the second terminal of the first driving transistor, and the control terminal of the first compensation switch is configured to receive the corresponding one of the plurality of first scan signals; and a first capacitor, couple between the writing circuit and the control terminal of the first driving transistor, configured to receive the first data signal, wherein the second compensation circuit comprises:

a second driving transistor, comprising a first terminal, a second terminal, and a control terminal;

a second compensation switch, comprising a first terminal, a second terminal, and a control terminal, wherein the first terminal of the second compensation switch is coupled with the control terminal of the second driving transistor, the second terminal of the second compensation switch is coupled with the second terminal of the second driving transistor, the control terminal of the second compensation switch is configured to receive the corresponding one of the plurality of second scan signals; and a second capacitor, coupled between the writing circuit and the control terminal of the second driving transistor, configured to receive the second data signal, wherein the first terminal of the first driving transistor and the first terminal of the second driving transistor are coupled, in a parallel connection, with a first power terminal;

a reset circuit, configured to provide a reference voltage to the compensation circuit;

a brightness control circuit; and a light emission control circuit, coupled with the first compensation circuit, the second compensation circuit, and the brightness control circuit, wherein the light emission control circuit conducts, in the first time period, the first compensation circuit to the brightness control circuit according to the first emission signal so that the brightness control circuit emits according to the first driving current, the light emission control circuit conducts, in the second time period, the second compensation circuit to the brightness control circuit according to the second emission signal so that the brightness control circuit emits according to the second driving current, and the first emission signal is opposite to the second emission signal.

14. The display panel of claim 13, wherein the light emission control circuit comprises:

a first emission switch, comprising a first terminal, a second terminal, and a control terminal, wherein the first terminal of the first emission switch is coupled with the first compensation circuit, and the control terminal of the first emission switch is configured to receive the first emission signal; and a second emission switch, comprising a first terminal, a second terminal, and a control terminal, wherein the first terminal of the second emission switch is coupled with the second compensation circuit, and the control terminal of the second emission switch is configured to receive the second emission signal, wherein the second terminal of the first emission switch and the second terminal of the second emission switch are coupled, in a parallel connection, with the brightness control circuit.

15. The display panel of claim 13, wherein the reset circuit comprises:

a first reset switch, comprising a first terminal, a second terminal, and a control terminal, wherein the first terminal of the first reset switch is coupled with the first compensation circuit, and the control terminal of the first reset switch is configured to receive a first reset signal; and a second reset switch, comprising a first terminal, a second terminal, and a control terminal, wherein the first terminal of the second reset switch is coupled with the second compensation circuit, the control terminal of the second reset switch is configured to receive a second reset signal, wherein the second terminal of the first reset switch and the second terminal of the second reset switch are configured to receive the reference voltage.

16. The display panel of claim 13, wherein the writing circuit comprises:

a first node, configured to provide the first data signal;

a first writing switch, comprising a first terminal, a second terminal, and a control terminal;

a second writing switch, comprising a first terminal, a second terminal, and a control terminal, wherein the first terminal of the first writing switch and the first terminal of the second writing switch are coupled with the first node;

a second node, configured to provide the second data signal;

a third writing switch, comprising a first terminal, a second terminal, and a control terminal; and a fourth writing switch, comprising a first terminal, a second terminal, and a control terminal, wherein the first terminal of the third writing switch and the first terminal of the fourth writing switch are coupled with the second node, wherein the second terminal of the first writing switch and the second terminal of the third writing switch are coupled with a data line, the second terminal of the second writing switch and the second terminal of the fourth writing switch are configured to receive the reference voltage, the control terminal of the first writing switch and the control terminal of the fourth writing switch are configured to receive the first emission signal, and the control terminal of the second writing switch and the control terminal of the third writing switch are configured to receive the second emission signal.

17. The display panel of claim 13, wherein the brightness control circuit comprises:

an input terminal, coupled with the light emission control circuit, configured to receive the first driving current or the second driving current;

a first light emission element, comprising a first terminal and a second terminal; and a second light emission element, comprising a first terminal and a second terminal, wherein the first terminal of the first light emission element and the first terminal of the second light emission element are coupled, in a parallel connection, with the input terminal.

18. The display panel of claim 13, wherein the brightness control circuit comprises:

a first light emission element; and a second light emission element, wherein the first light emission element and the second light emission element are configured to receive the first driving current and the second driving current, respectively, from the light emission control circuit.

* * * * *